United States Patent [19]

Yagi et al.

[11] Patent Number: 4,723,480

[45] Date of Patent: Feb. 9, 1988

[54] MANUFACTURING APPARATUS WITH AIR CLEANING DEVICE

[75] Inventors: Katsuhito Yagi; Yuuji Isayama; Tatsuo Yoshitomi, all of Niigata, Japan

[73] Assignee: Hitachi, Ltd., Tokyo, Japan

[21] Appl. No.: 853,554

[22] Filed: Apr. 18, 1986

[30] Foreign Application Priority Data

Apr. 19, 1985 [JP] Japan ..... 60-82319
Dec. 11, 1985 [JP] Japan ..... 60-276702

[51] Int. Cl.[4] ..... B08B 15/02

[52] U.S. Cl. ..... 98/115.3; 98/1.5; 98/33.1; 98/115.4

[58] Field of Search ..... 98/115.3, 1.5, 33.1; 312/257 SK, 257 A; 55/385 A, DIG. 18

[56] References Cited

U.S. PATENT DOCUMENTS 3,875,853 4/1975 Pielkenrood ..... 98/115.3 X
4,466,454 8/1984 Layton ..... 98/115.3 X
4,611,866 9/1986 Everett ..... 312/257 SM

*Primary Examiner*—Harold Joyce
*Attorney, Agent, or Firm*—Fay, Sharpe, Beall, Fagan, Minnich & McKee.

[57] ABSTRACT

A manufacturing apparatus equipped with product transfer means is arranged along the flow of products and provided with an air cleaning device. A partition panel is provided the downstream side of the clean air blow-off vent of the air cleaning device so as to form a clean air passageway and prevent dust from penetrating into the passageway, so that goods are manufactured and transferred in the cleaned air passageway.

14 Claims, 27 Drawing Figures

MANUFACTURING APPARATUS WITH AIR CLEANING DEVICE

BACKGROUND OF THE INVENTION

The invention relates to an apparatus for manufacturing goods to be manufactured in clean surroundings and more particularly to a manufacturing apparatus with an air cleaning device (hereinafter referred to as the manufacturing apparatus) fit for not only plant and equipment cost reduction but also energy-saving.

There is a known method of the sort disclosed in Japanese Patent Application (OPI) No. 127033/83 for providing clean surroundings where articles such as semiconductors and pharmaceuticals are manufactured, the method comprising installing a manufacturing apparatus in a clean air supply unit built in the form of a tunnel. However, drawbacks considered inherent in such a method include allowing dust blown off from the worker to affect products because the worker and the manufacturing apparatus are present within the same atmosphere, transfer means installed on the manufacturing apparatus to remain within a turbulent flow area generated by the air current reflected from and thus curved on the surface of the manufacturing apparatus and consequently products being transferred to be contaminated; the reason for this is that the former method is based on no technological concept of arranging for the air current to pass through the manufacturing apparatus.

The conventional system configuration is still disadvantageous in that equipment cost reduction and energy-saving are hardly accomplishable because it is designed to supply clean air to the surroundings of the manufacturing apparatus and also the passageway for the worker.

SUMMARY OF THE INVENTION

An object of the present invention is to provide a less expensive energy-saving apparatus for manufacturing articles that must be manufactured in clean surroundings.

The apparatus for manufacturing articles to be manufactured in clean surroundings according to the present invention comprises means for manufacturing articles on the assembly line, the means being equipped with product transfer means and arranged along the flow of products, a clean air blow-off vent for supplying clean air to the manufacturing means, an outer shell for covering the manufacturing means and forming the flow path of the clean air blown off from the clean air blow-off vent around the manufacturing means, and clean air supply means communicating with the upstream of the clean air blow-off vent.

The present invention is intended to introduce a less costly apparatus for manufacturing goods to be manufactured in clean surroundings and make obtainable an energy-saving manufacturing apparatus during operation.

DESCRIPTION OF THE PREFERRED EMBODIMENTS

Referring now to FIGS. 1 through 11, embodiments of the present invention will be described.

Figure 1:
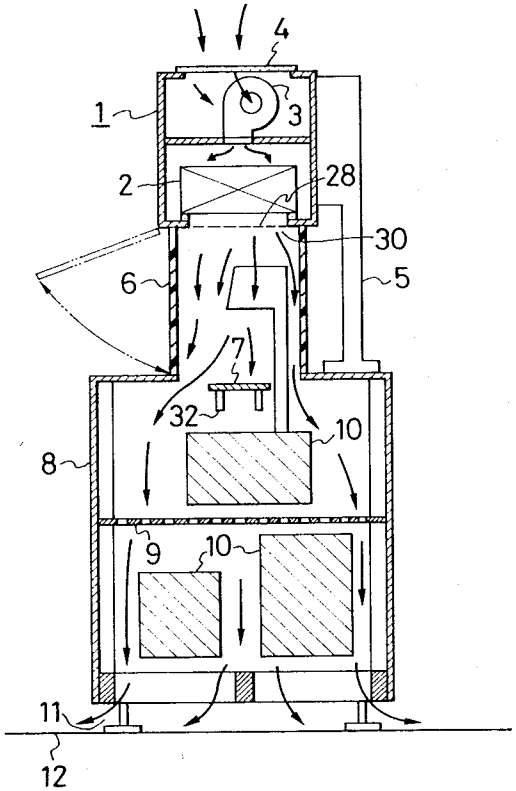
FIG. 1 is a side sectional view of a manufacturing apparatus representing a first embodiment of the present invention.

FIG. 1 is a side elevational view of a first embodiment of the present invention. The construction of a manufacturing apparatus as a whole is such that an encased air cleaning device 1 as clean air supply means containing a filter and a blower is installed on a body case 8 as the outer shell of the apparatus with a metal support 5, the body case 8 containing mechanical means 10 for manufacturing products 7. Air is sucked by a blower 3 through a prefilter 4 and cleaned by a HEPA filter 2 before being sent to the section enclosed by a hood 6 through a clean air blow-off vent 30. An arrow in FIG. 1 indicates an air current. The surroundings of the products 7 are cleaned by the clean air sent from above. The hood 6 should preferably be prepared from transparent material and openable or detachable, whereby the products 7 on a conveyer 32 as transfer means can be inspected and apparatus maintenance is workable. The clean air current is forced in from above by the blower 3 and caused to pass through the body case 8 of the manufacturing apparatus. In that case, a resistance plate 9 is installed in the body case 8 of the apparatus so as to provide ventilating resistance. The ambient pressure of the products 7 is thus kept positive to only the extent of the ventilating resistance relative to the exterior of the apparatus and external contaminated air is prevented from penetrating inward. Moreover, the clean air is usable for preventing the dust generated out of the mechanical means 10 of the manufacturing apparatus from affecting the products 7. An ingenuously contrived arrangement of mechanical means 10 in place of the installation of the resistance plate 9 will make possible the omission of the installation of the latter, provided that ventilating resistance equivalent thereto is available.

Figures 3A, 3B:
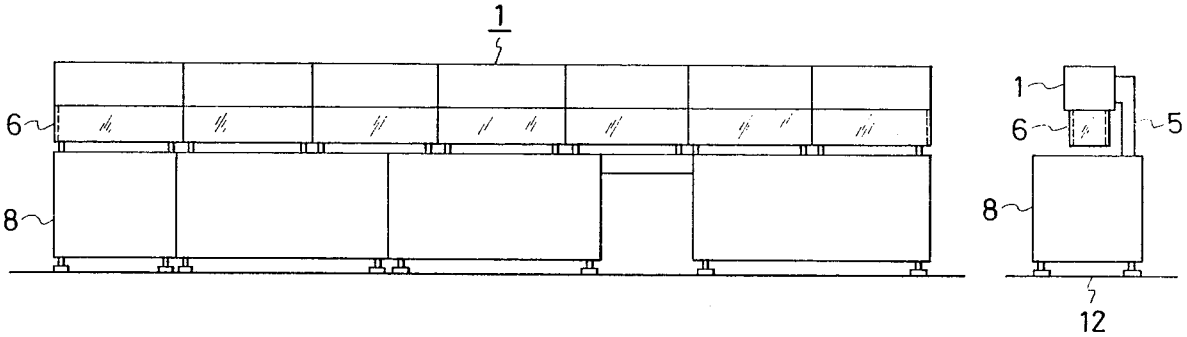
FIGS. 3(*a*), (*b*) are an elevational view and a side view illustrating the external appearances of the manufacturing apparatus representing the first embodiment of the present invention.

FIG. 3 illustrates exterior elevational and side views of this embodiment. The front elevational length of the manufacturing apparatus increases and decreases depending on the process of manufacture of products.

Figure 2:
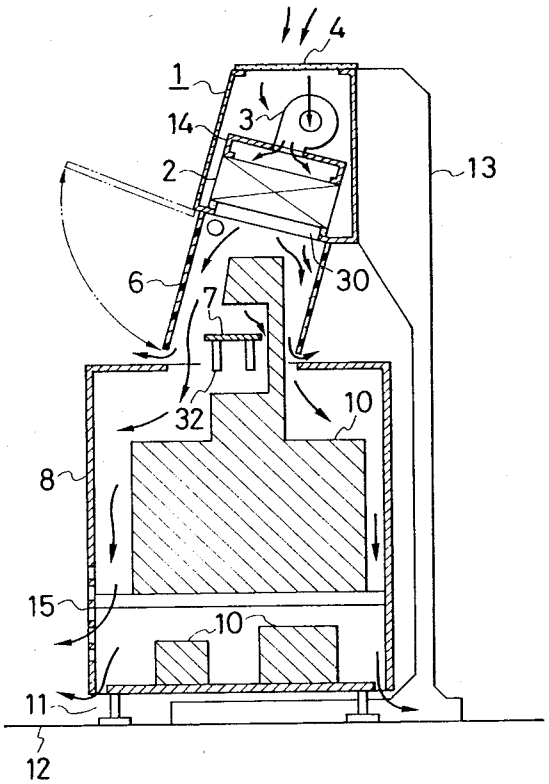
FIG. 2 is a side sectional view of a manufacturing apparatus representing a second embodiment of the present invention.

FIG. 2 illustrates a second embodiment of the present invention, which is similar in the overall construction and operation to the first embodiment but different therefrom in that the encased air cleaning device 1 is supported by the metal support 13 on a floor 12 but not connected with the manufacturing apparatus body case 8.

In the manufacturing apparatus thus constructed, the vibration of the blower 3 is prevented from being transmitted to the manufacturing apparatus. Moreover, a positive pressure chamber 14 installed between the blower 3 and the HEPA filter 2 allows the perimeter of the HEPA filter 2 to communicate with the suction vent of the blower 3, thus making the internal pressure of the HEPA filter negative to the extent of the internal pressure lost of the prefilter 4, whereby the air contaminated because of the HEPA filter unsatisfactorily sealed is prevented from leaking into the cleaned section enclosed with the hood 6.

A small space is provided between the hood 6 and the body case 8 of the manufacturing apparatus to prevent the transmission of the vibration. However, since the air pressure adjacent the product 7 is positive as in the case of the first embodiment, there is producted an outwardly directed air current, which prevents the contaminated air from flowing in. A similar effect is achieved with respect to the leakage space 11. For a manufacturing apparatus almost airtightly enclosed in a body case 8, an exhaust gallery 15 may be provided for ventilating purposes.

Both of the blower 3 and the HEPA filter 2 have been installed on the manufacturing apparatus according to the above embodiments. However, they may separately be installed so as to supply clean air to the section enclosed with the hood 6.

Although the HEPA filter 2 should preferably be installed in the direction wherein the products 7 are continuously conveyed, it may be installed spaced apart therefrom when it is unnecessary to provide so much high air cleaning efficiency and a diffusion plate 28 shown in FIG. 1 may be installed so as to blow off and diffuse the clean air.

Figure 4:
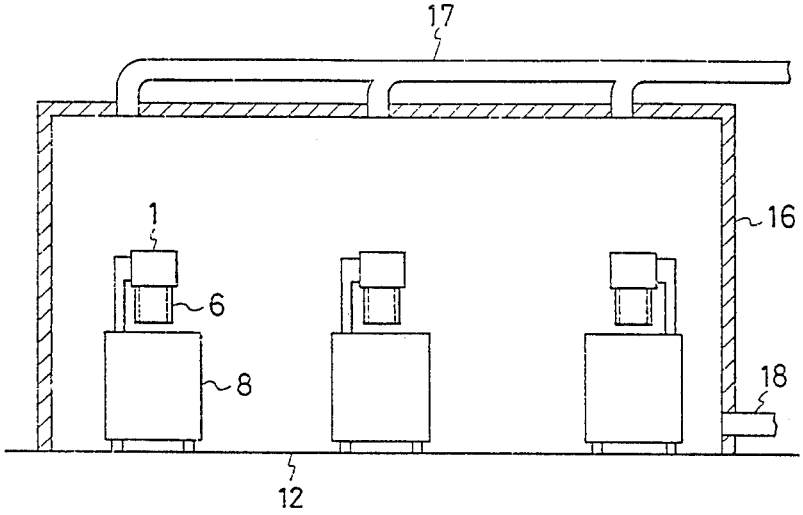
FIG. 4 is a side view of a clean room accommodating the manufacturing apparatus representing the first embodiment of the present invention.
Figure 5:
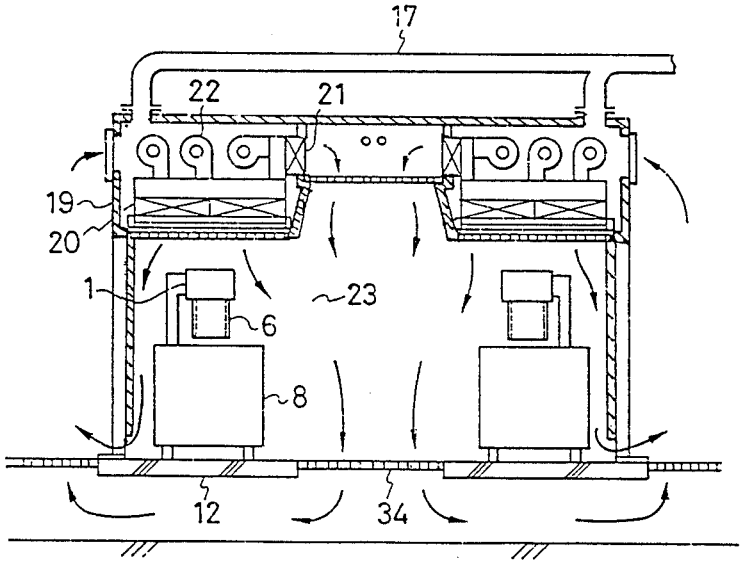
FIG. 5 is a side view of a clean working room according to Japanese Patent Application (OPI) No. 127033/83, the clean working room accommodating the manufacturing apparatus representing the first embodiment of the present invention.

FIGS. 4 and 5 show the way the manufacturing apparatus representing the first embodiment of the present invention is installed. FIG. 4 illustrates three lines of the manufacturing apparatuses with air cleaning devices according to the present invention in a room 16. In that case, it is only necessary to provide the room 16 with ordinary air-conditioning by means of a conditioned air supply duct 17 and an air circulating duct 18.

Heretofore, such a room 16 must be a clean room and it inevitably becomes costly. On the contrary, the clean room in accordance with the present invention requires a by far small quantity of clean air and is effective in reducing equipment cost and saving energy.

FIG. 5 illustrates the manufacturing apparatus and the present invention installed in a clean air working room of the sort disclosed in Japanese Patent Application (OPI) No. 127033/83. This is effective in reducing equipment cost and energy saving compared with the conventional down-flow type clean air room without the present invention. The embodiment represents an example wherein the surrounding of products such as LSIs must be cleaned.

The clean working room 23 of the sort disclosed thereby can naturally be provided less costly than the down flow type one without the present invention. However, it requires the use of blowers 22, partitions 19, HEPA filters 20 and 21 as a cleaning element and circulation duct 34. It will involve an enormous cost if a HEPA filter having a dust collecting efficiency of 99.9995% with a grain size of 0.1 μm is used for extra-high cleaning purposes. Moreover, the life of the filter will be shortened. On the other hand, the manufacturing apparatus as a whole will become inexpensive, with extra-high air cleaning being readily achievable, provided that a HEPA filter of 99.99% with a grain size of 0.3 μm is used and that the manufacturing apparatus according to this embodiment is installed in the clean working room together with a HEPA filter of 99.9995% with a grain size of 0.1 μm. In addition, the life of the manufacturing apparatus will be prolonged because the air supplied to the expensive HEPA filter for the grain size of 0.1 μm is also cleaned. This method is thus effective in cleaning air less expensively.

Figure 6:
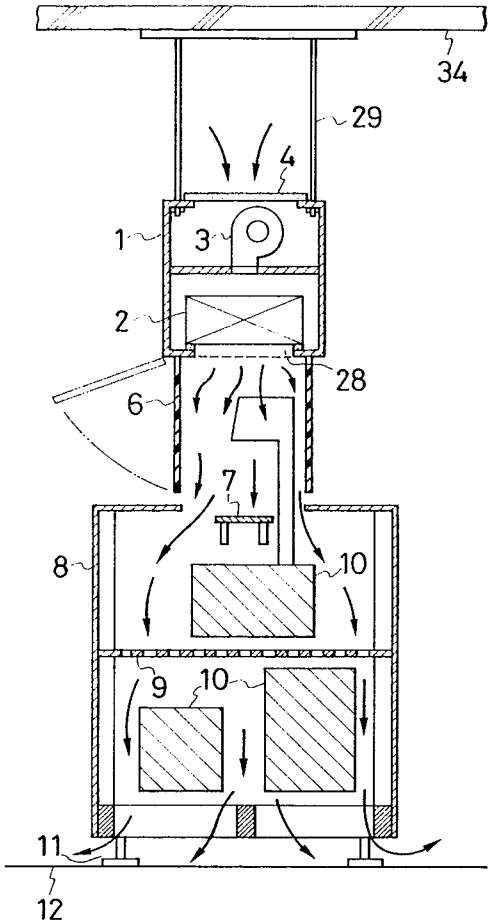
FIG. 6 is a side sectional view of a manufacturing apparatus representing a third embodiment of the present invention.

FIG. 6 is a side sectional view illustrating a third embodiment of the present invention. The encased air cleaning device 1 is suspended from the ceiling 34 of the working room with bolts 29 according to this embodiment. The hood 6 is openably hinged under the clean air blow-off vent diffuser 30 of the encased air cleaning device 1 and there is also provided a gap for the insulation of vibration between the hood 6 and the body case 8. Since the encased air cleaning device 1 is suspended from the ceiling with the gap between the hood 6 and the body case 8, the vibration of the encased air cleaning device 1 is sure to be insulated and the absence of the metal support 13 for the encased air cleaning device 1 provides a wider space in the clean working room.

Figure 7:
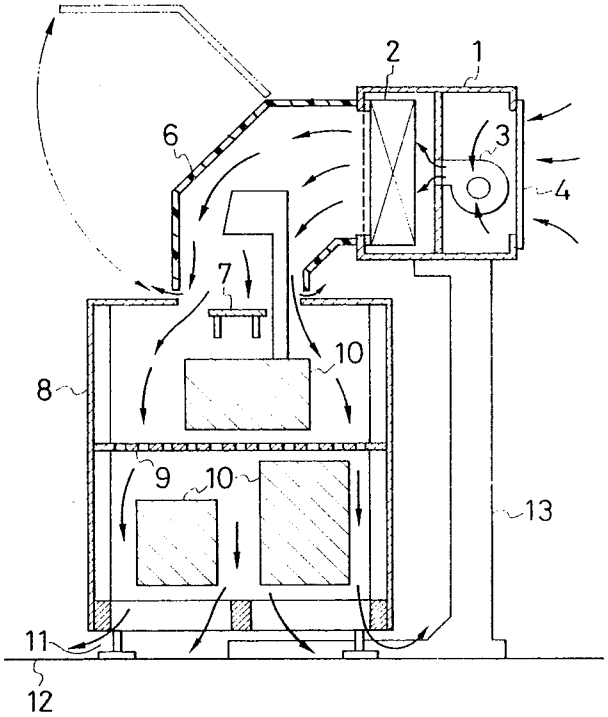
FIG. 7 is a side sectional view of a manufacturing apparatus representing a fourth embodiment of the present invention.

FIG. 7 is a side sectional view illustrating a fourth embodiment of the present invention. The encased air cleaning device 1 is supported by the metal support 13 according to this embodiment in such a manner as to cause the air current to jet out in the upper diagonal direction of the body case 8. The clean air blow-off vent of the air cleaning device 1 is provided with the hood 6 for introducing the air current in the lower diagonal direction and the hood 6 is openably hinged, whereas a gap for the insulation of vibration is formed between the lower end of the hood 6 and the body case 8. Since the encased air cleaning device 1 is supported by the metal support 13 in the upper diagonal section of the body case 8 according to this embodiment, the total height of the apparatus can be shortened.

Figure 8:
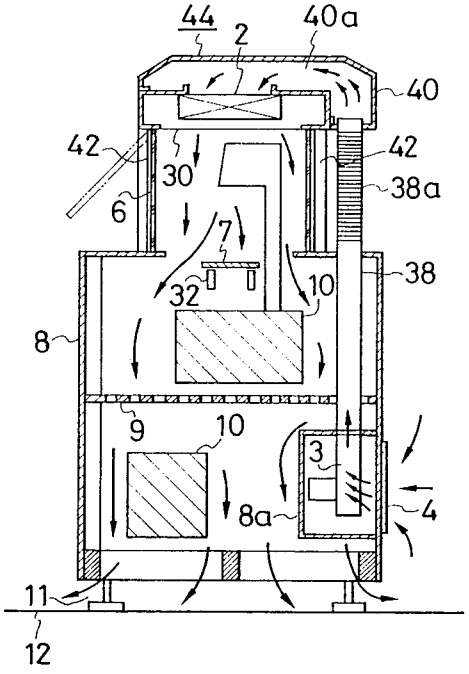
FIG. 8 is a side sectional view of a manufacturing apparatus representing a fifth embodiment of the present invention.
Figure 10:
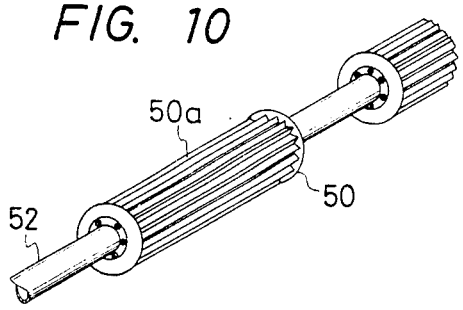
FIG. 10 is a perspective view illustrating the way a filter is attached according to the sixth embodiment of the present invention.

FIG. 8 is a side sectional view illustrating a fifth embodiment of the present invention. The blower 3 is contained in the body case 8 according to this embodiment. The blower 3 is installed in a lower section of the body case 8 and covered with a partition plate **8*a* so as to allow the suction port to communicate with only the exterior of the body case 8. The blow-off vent of the fan 3 communicates with a filter case 40 supported by a pillar 42 in the upper section of the body case through a duct 38 passing therethrough. A section of the duct 38 between the body case 8 and the filter case 40 may be a flexible duct 38*a*. A pressure chamber 40*a* is formed above the filter case 40 and clean air is supplied to the space enclosed by the hood 6 through the filter 2 installed below the pressure chamber 40*a* and the clean air blow-off vent 30. In other words, clean air supply means 44 according to this embodiment comprises the prefilter 4, the blower 3, the duct 38, the filter case and the HEPA filter 2**. According to this embodiment, the pressure in the manufacturing apparatus can be kept positive even if the blower is contained therein and the total height thereof can be shortened.

Figure 9:
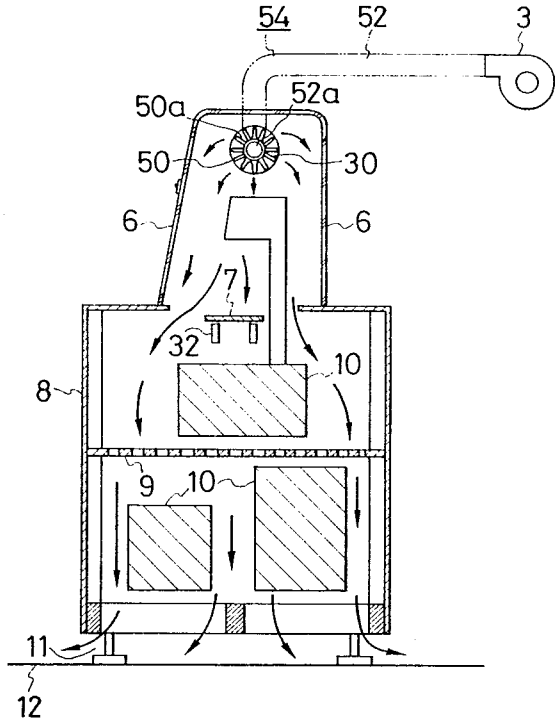
FIG. 9 is a side sectional view of a manufacturing apparatus representing a sixth embodiment of the present invention.

FIG. 9 is a side sectional view illustrating a sixth embodiment of the present invention. The fan is installed separately from the manufacturing apparatus according to this embodiment and the air is supplied to the space enclosed with the hood 6 through a duct 52. A cylindrical HEPA filter 50 is employed as a filter according to this embodiment. The duct 52 is airtightly coupled to the HEPA filter 50 shown in FIG. 10. The interior **52*a* of the HEPA filter 50 is allowed to communicate with the duct 52 and clean air is supplied to the space enclosed with the hood 6 through a folded filter medium attached to the periphery of the HEPA filter 50. For that reason, the outer surface 50*a* of the filter medium of the HEPA filter 50 forms a clean air blow-off vent 30 according to this embodiment. In other words, clean air supply means 54 according to this embodiment comprises the blower 3, the duct 52 and the HEPA filter 50**, so that the construction of the filter case is simplified.

Figure 11:
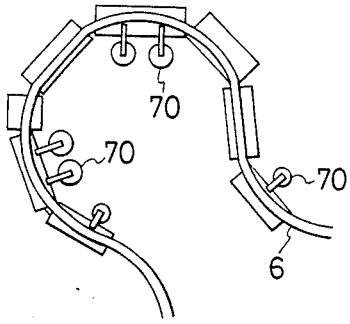
FIG. 11 is a top view illustrating the layout of a manufacturing apparatus embodying the present invention.

An arrangement of manufacturing apparatuses should not always be linear as shown in FIG. 3 but arciform in combination with industrial robots 70 shown in FIG. 11. In that case, an air curtain in place of the hood 6 may be used to screen the apparatus from the outside.

Figure 12:
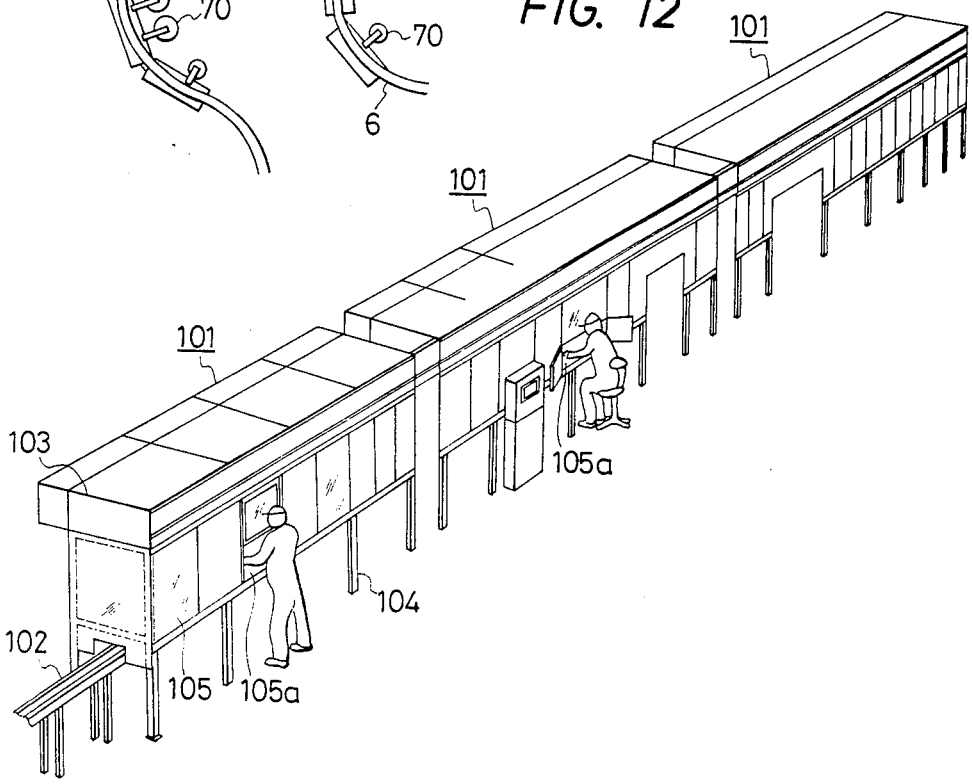
FIG. 12 is a perspective view of a manufacturing apparatus representing a seventh embodiment of the present invention.
Figure 13:
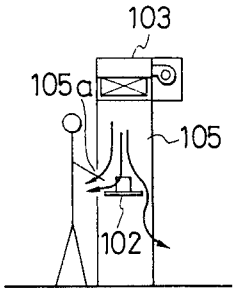
FIG. 13 is a side sectional view illustrating a worker's position and a state of air current in the manufacturing apparatus representing the seventh embodiment of the present invention.

The above embodiments are designed to clean the surroundings of conveyer means only by building a partition close to the conveyer means such as a conveyer on the production line. However, a partition may be installed in such a manner as to enclose the conveyer means and the manufacturing apparatus shown in the following embodiments:

Referring to FIGS. 12, 13, the manufacturing apparatus according to a seventh embodiment of the present invention will be described.

A manufacturing apparatus 101 according to this embodiment comprises a clean air supply unit 103 as an air cleaning device installed above a production line 102 and a partition panel 105 as what encloses the production line 102 around the clean air blow-off vent thereof. The clean air supply unit 103 according to this embodiment is supported by a pillar 104 on the floor. Clean air is supplied by the clean air supply unit 103 to the space formed with the partition panel 105 and the clean air blow-off vent of the clean air supply unit so that the atmosphere surrounding products may be cleaned. A proper working opening **105*a* is provided for the partition panel 105, whereby the worker is allowed to handle goods on the production line from the outside of the partition panel 105 through the working opening 105*a*. Since the working opening 105*a*** is positioned on the downstream side of the air current relative to the goods on the production line, the goods on the line will be unaffected by the dust brought forth by the worker even though he touches the goods through the opening.

Figure 14:
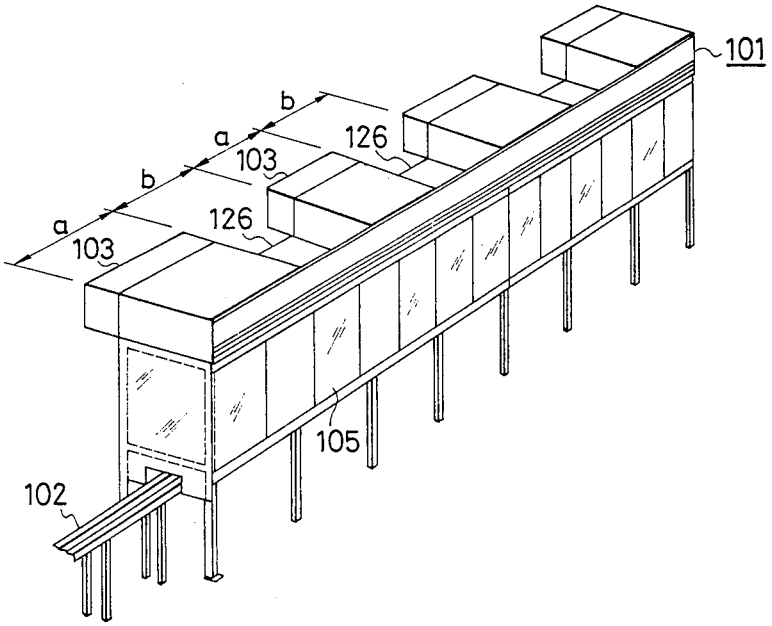
FIG. 14 is a perspective view of a manufacturing apparatus representing an eighth embodiment of the present invention.

FIG. 14 shows an eighth embodiment of the present invention.

The clean air supply units 103 are discontinuously installed according to this embodiment, which comprises a proper combination of the clean air supply units 103 and ceiling panel units 126 blowing no clean air as shown in FIG. 14 and is applicable when the cleanliness required is not so high.

The intended cleanliness can be obtained by changing the ratio of the dimensions of the clean air supply unit 103 and those of the ceiling panel unit 126, and regulating the total circulation cycle.

Figure 15:
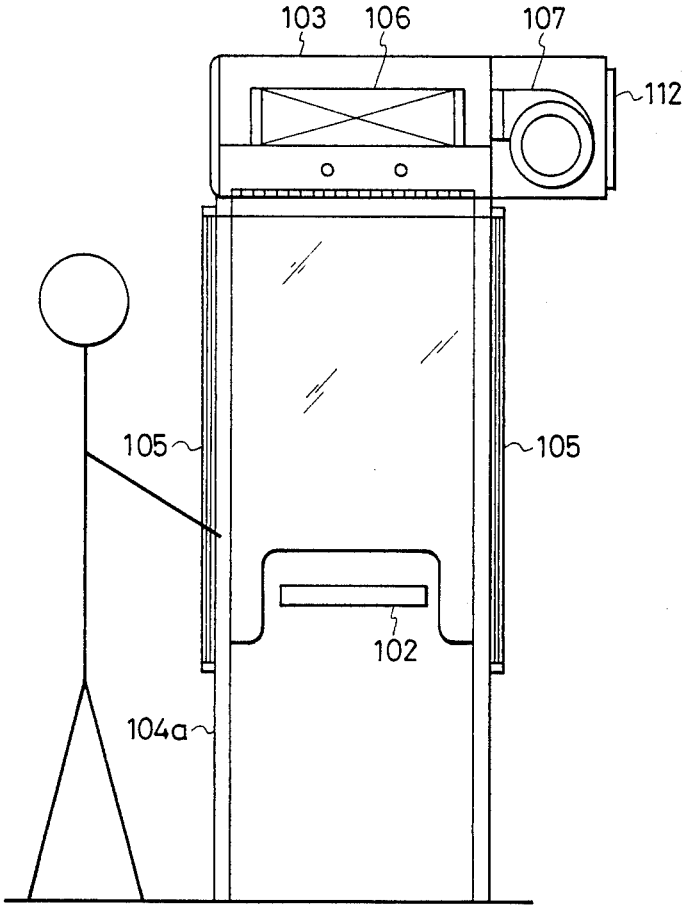
FIG. 15 is a side sectional view illustrating the construction of a clean air supply unit for the manufacturing apparatus representing the seventh, eighth, tenth and eleventh embodiments of the present invention.

Referring to FIG. 15, the basic construction of the manufacturing apparatus 101 will be described. The clean air supply unit 103 comprises a main filter 106 as air filtering means and a blower 107 as pressurized air sending means, the air supply unit capable of supplying clean air being supported by a portal leg **104*a***.

The clean air supply unit 103 shown in FIG. 15 represents what is equipped with the blower 107 horizontally relative to the main filter 106. The blower 107 is protruded from the air cleaning area of the production line and sucks air through a prefilter 112. Although the blower 107 is protruded in the direction perpendicular to the long direction of the production line shown in FIG. 15, working on both sides thereof will become easy if that portion is located in the longitudinal direction of the line.

Figure 16:
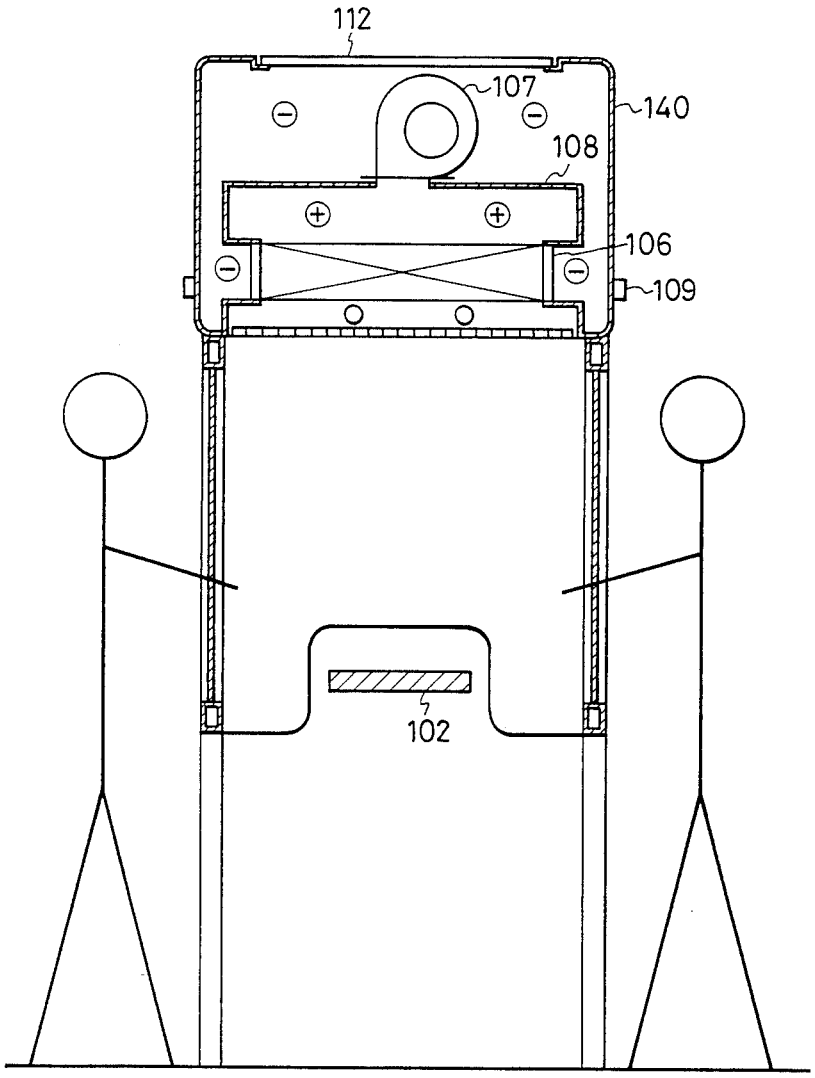
FIG. 16 is a side sectional view illustrating a first modification of the clean air supply unit.

FIG. 16 shows a first modification of the clean air supply unit, wherein the blower 107 is attached to the pressurizing chamber 108, which is attached to the main filter, whereby air is sucked through the prefilter 112 installed on the ceiling of clean air supply means 140.

The width of the clean air supply unit 140 can be made equivalent to the cleaning zone of the manufacturing apparatus 101 according to the modification and moreover working on both sides is facilitated as the blower 107 is not protruded from the cleaning zone.

As the pressure around the main filter 106 can be kept negative, contaminated air will be prevented from penetrating into the cleaning zone even if the cubic body of the clean air supply unit has an opening, so that sealing work is simplified when control devices such as switches and pressure difference gauges are attached.

Switches 109 for operating the blower 107 installed on both sides of the clean air supply unit 140 as a three-way switch make it possible to control, e.g., operate and stop, the manufacturing apparatus from both sides.

Figure 17:
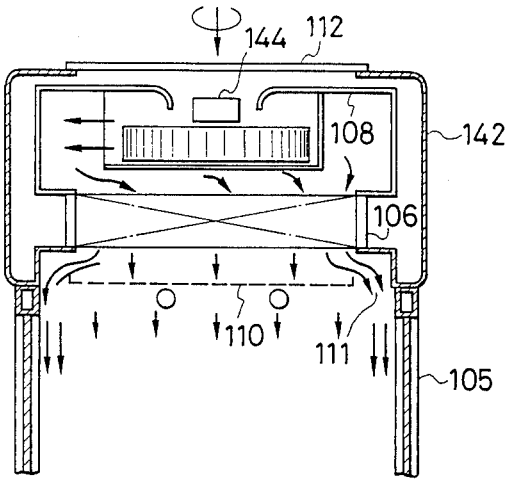
FIG. 17 is a side sectional view illustrating a second modification of the clean air supply unit.

FIG. 17 shows a second modification of the clean air supply unit wherein a horizontal blower 144 is installed above the main filter 106 to facilitate the operation on both sides as in the case of the first modification. According to this modification, the height of the clean air supply unit can be made shorter than that of the first modification and consequently the total height of the manufacturing apparatus 101 is shortened. That modification is fit for air cleaning in a low working room. Moreover, an air curtain current having a velocity higher than that in the central section of the manufacturing apparatus 101 can be formed inside the partition panel 105 by installing a punching plate 110 as air resistance increasing means at the clean air blow-off vent so as to provide a slit air curtain blow-off vent 111. Consequently, the penetration of external air into the cleaned air of the manufacturing apparatus is minimized to ensure stable cleanliness therein even when the partition panel 105 is opened.

Figure 18:
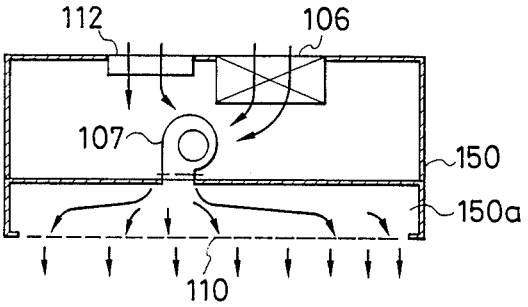
FIG. 18 is an elevational sectional view illustrating a third modification of the clean air supply unit.

FIG. 18 shows a third modification of the clean air supply unit.

This modification is designed to blow air over the whole area covering the manufacturing apparatus 101 after blending clean air filtered through the main filter efficiently with air containing dust concentration higher than that of the clean air and making the air have the intended cleanliness.

A clean air supply unit 150 according to this modification comprises the main filter 106 and the prefilter 112 on the suction side, whereby the punching plate 110 as air resistance increasing means is allowed to uniformly blow off air over the whole blow-off area 150*a* of the clean air supply unit 150.

Figure 19:
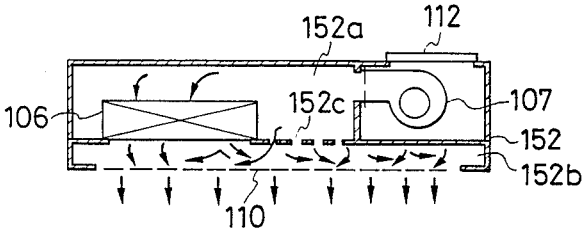
FIG. 19 is an elevational sectional view illustrating a fourth modification of the clean air supply unit.

FIG. 19 shows a fourth modification of the clean air supply unit.

A clean air supply unit 152 according to this modification comprises the prefilter 112 on the suction side of the blower 107, the blow-off vent of the blower communicating with a first pressurizing chamber 152*a*, the main filter 106 and a through hole 152*c* between the first pressurizing chamber 152*a* and a second pressurizing chamber 152*b* formed thereunder, and the punching plate 110 as air resistance increasing means installed below the second pressurizing chamber 152*b*. The air deprived of coarse dust by the filter 112 is supplied to the first pressurizing chamber 152*a* and then the second pressurizing chamber 152*b* through either the main filter 106 or the through hole 152*c*. The air thus supplied is mixed up to become what has given cleanliness and blown off the whole area of the vent of the clean air supply unit 152 at a uniform velocity.

By continuously installing the third and fourth modified clean air supply units above the production line to form the manufacturing apparatus the air having intended cleanliness can uniformly be blown off over the manufacturing apparatus so that the cleanliness can be made uniform over the whole manufacturing apparatus even when a high grade of cleanliness is not required.

Figure 20:
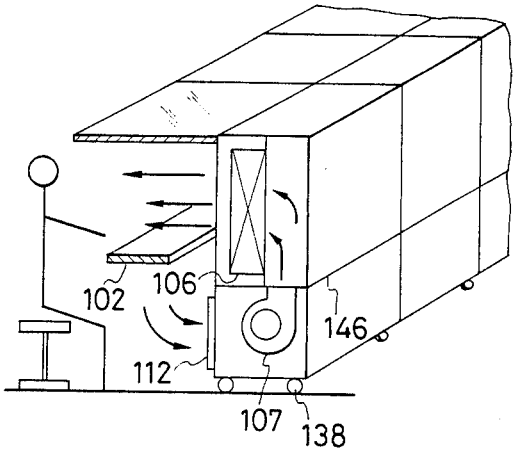
FIG. 20 is a perspective view of a manufacturing apparatus representing a ninth embodiment of the present invention.

FIG. 20 illustrates a ninth embodiment of the present invention. A horizontal air current type clean air supply unit 146 equipped with the blower 107 and the main filter 106 is installed along one side of the production line, whereby clean air is horizontally blown off according to this embodiment.

As the clean air supply unit 146 is provided with casters 138 on the bottom and thus made movable, it can easily be moved when the line conveyor 102 is altered or at the maintenance of the inner mechanism.

When the article moving on the line 102 is relatively small, accordingly causing no turbulence in the horizontal clean air current, the clean air supply unit 146 can be made small in size because an area to be cleaned is minimized.

Figure 21:
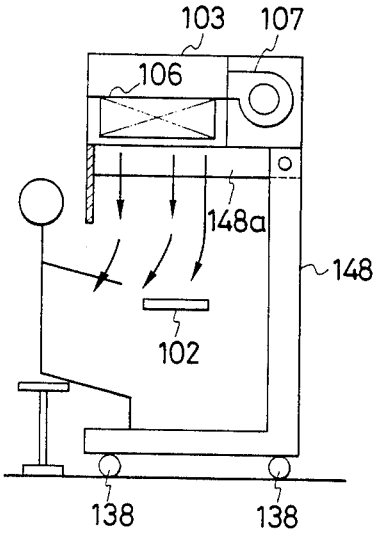
FIGS. 21 and 22 are side views respectively illustrating the clean air supply units horizontally placed and diagonally lifted up on the air cleaning line representing a tenth embodiment of the present invention.
Figure 22:
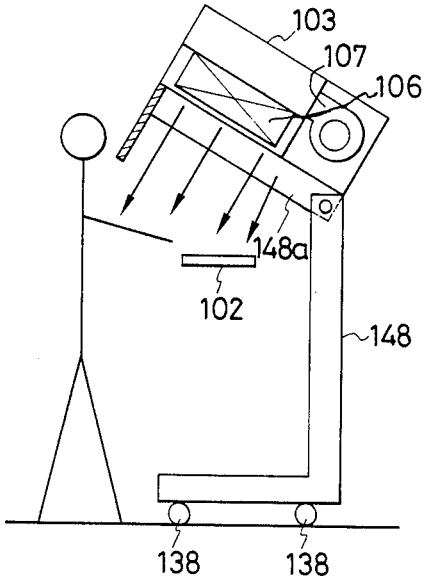

FIGS. 21, 22 illustrate a tenth embodiment of the present invention.

There is provided a C-shaped leg 148 according to this embodiment of the present invention, the upper side of the C-shaped leg is movably supported relative to the remaining two sides, and the clean air supply means 103 is mounted on and fixed to the upper side. The upper side 148*a* of the C-shaped leg 148 according to the embodiment of the present invention is rotatably clamped with bolts relative to the other two sides. FIG. 21 illustrates the clean air supply unit while it is directed horizontally, whereas FIG. 22 illustrates the supply unit rotated in such a manner as to supply clean air to the line 102 in the upper diagonal direction. As the blow-off direction of the clean air can properly be regulated depending on the intended object according to this embodiment, an ideal air current can readily be formed. The blow-off vent can be placed close to the line 103 so as to prevent an outer air current from flowing inward, provided that not only angular but also height adjustments are made possible. The height adjustment is implemented by employing a flexible vertical leg section 148 which can be fixed at a desired height with bolts as in the case of the angular adjustment.

Figure 23:
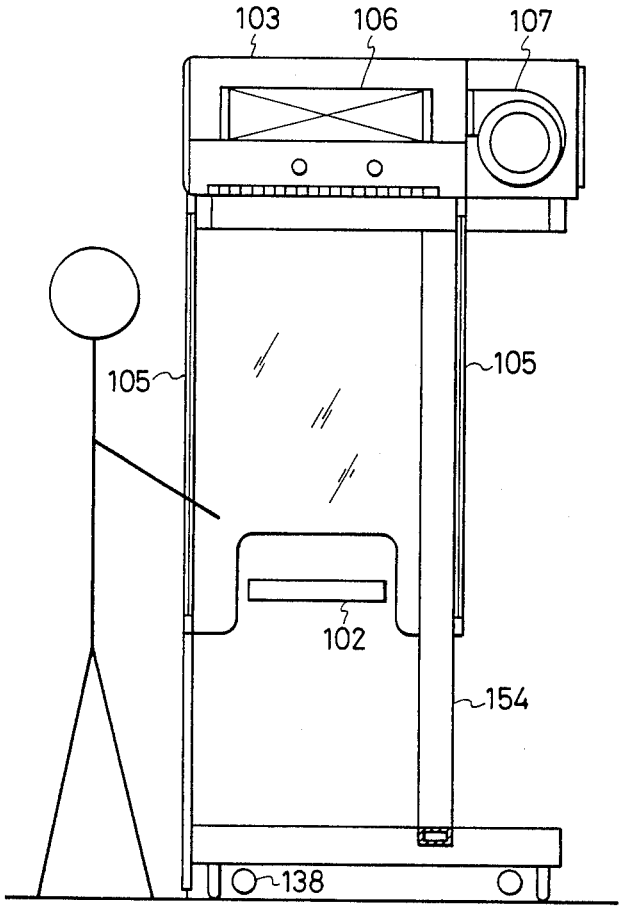
FIG. 23 is a side sectional view of a manufacturing apparatus representing an eleventh embodiment of the present invention.

FIG. 23 illustrates an eleventh embodiment of the present invention.

This manufacturing apparatus is equipped with the clean air supply unit 103 mounted on an I-shaped leg 154 and the caster 138 on the under surface thereof.

The leg 154 in the form a module and the clean air supply unit 103 are assembled in a place separated from the line 102 first and the assembly can be moved to the line 102 for installation. Consequently, the installation of the manufacturing apparatus is readily conducted. Moreover, the manufacturing apparatus is easily separated from the line 102 while the line 102 is subjected to inspection and maintenance.

The seventh, eighth and eleventh embodiments of the present invention will be described in detail.

Figure 24:
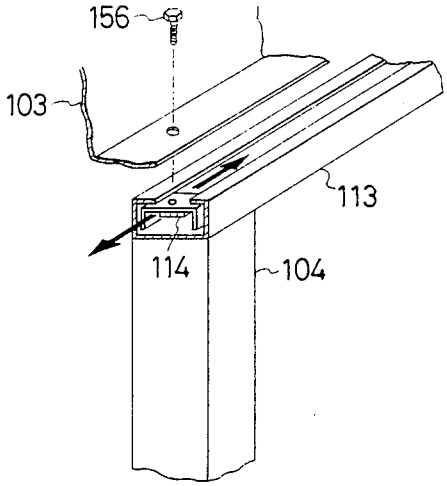
FIG. 24 is a perspective view illustrating the way the clean air supply unit and the upper leg members are fixed according to the seventh, eighth and eleventh embodiments of the present invention.

FIG. 24 illustrates fixtures for the clean air supply unit 103 and the leg 104. A U-shaped clean air supply unit fixing frame 113 is provided above the leg 104 along the long direction of the cleaning line, whereas a metal fitting 114 is slidably inserted into the fixed frame 113 of the clean air supply unit. The clean air supply unit 103 is clamped to the metal fitting 114 with a screw 156 so as to readily move the clean air supply unit to where the highest cleanliness is required on the line 102.

In consequence, that mechanism can readily deal with alterations in not only the line layout but also cleanliness.

Figure 27:
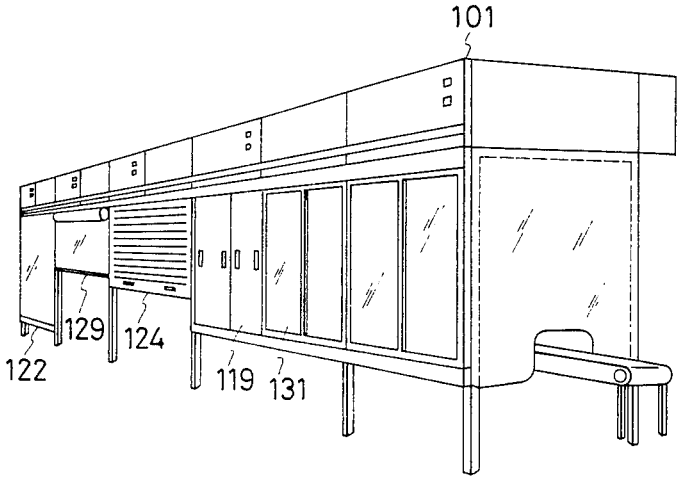
FIG. 27 is a perspective view illustrating an air cleaning line comprising, in combination, various kinds of partition panels.
Figure 25:
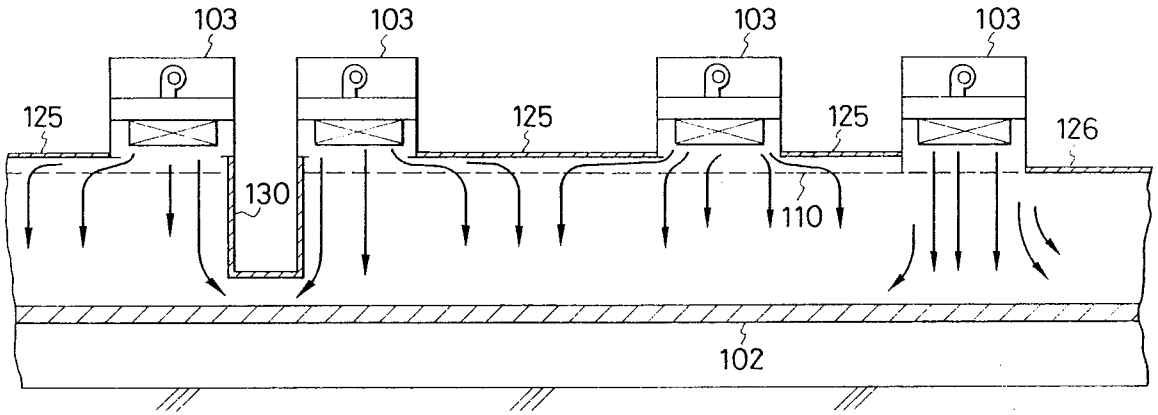
FIG. 25 is an elevational view illustrating a manufacturing apparatus comprising modified clean air units.
Figure 26:
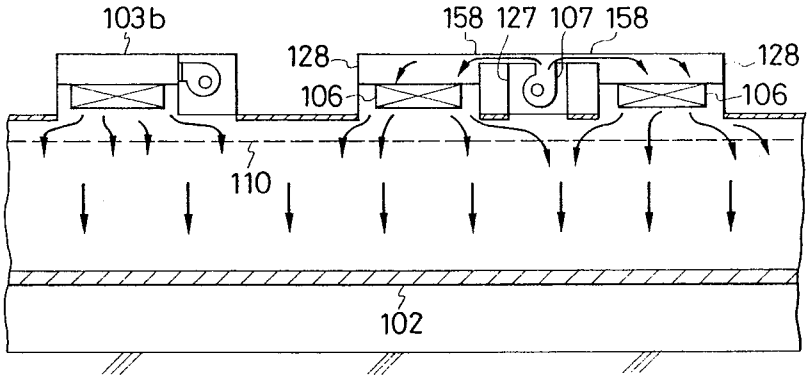
FIG. 26 is an elevational view illustrating a clean air line comprising, in combination, a blower unit, an air filter unit and a reoriented clean air supply unit.

FIG. 25 through 27 illustrate cleaning lines respectively comprising combinations of embodiments and modifications.

The manufacturing apparatus 101 comprises a combination of the clean air supply unit 103 capable of sucking the air and supplying clean air, the blow-off unit 125 for receiving the clean air from the clean air supply unit 103 and blowing the air to the manufacturing apparatus, the ceiling panel unit 126 incapable of blowing the cleaned air, the coupling hood 130 for keeping the surface of the line clean by causing the clean air on both sides thereof in case no cleaning construction is installable thereon because steps are installed on the ceiling 126 to provide a passageway toward the opposite side of the line 102, a blower unit 127 for sucking, pressurizing and sending external air, and an air filtering unit 128 for filtering the external air sent out of the blower unit 127 and supplying clean air to the manufacturing apparatus.

The supply of clean air is undertaken by not only the clean air supply unit 103 but also one of the proper clean air supply units 140, 142, 150, 152 and 146 of FIGS. 16, 17, 18, 19, 20, depending on the object and use. Or otherwise, a combination of them is also acceptable. The blow-off unit 125 comprises the puching plate 110 as air resistance increasing means and the ceiling panel unit; i.e., the punching plate has a percentage of punched holes corresponding to the cleanliness required for the line 102.

The ceiling panel unit 126 is used for a section whose intended cleanliness is low and, if light transmitting material is used, it will help saving energy because the number of lamps inside the manufacturing apparatus 101 can be reduced by the light transmitted from the working room side.

FIG. 26 illustrates an arrangement of a blower and a plurality of air filtering units equipped with only the main filter for receiving air in combination with the air supply unit 103 mounted perpendicular to the conventional direction.

The blower unit 127 contains the blower 107, whose blow-off vent is caused to communicate with the air filtering unit 128 equipped with the main filter 106. The combination of the blower unit 127 and the air filtering unit 128 for pressurizing and sending the air from the former to the latter and then to the manufacturing apparatus 101 as cleaned air allows a plurality of air filtering units 128 to be coupled to one blower unit 127. Accordingly, that configuration helps simplify wiring to the blower.

Assuming the number of air filtering units 128 is large or a large quantity of air is required, a large-sized blower may be used to increase motor efficiency and save energy. Moreover, it is also possible to separately install the blower unit 127 and, in such an arrangement, the manufacturing apparatus 101 can be made lightweight and material cost also reducible because the load applied to the leg 104 is lightened.

The clean air supply unit 158 of FIG. 26 is installed perpendicular to the installed unit **103*b* that is similar to the unit as shown in FIG. 15. By locating the blower 107 in the long direction of the line 102** and removing anything which may form an obstacle in the upper section other than the cleaned one, any kind of work on both sides of the clean air supply units will be facilitated as in the case of the first modification thereof.

FIG. 27 shows applications of various partition panels to the manufacturing apparatus depending on the object and use thereof.

The manufacturing apparatus shown in FIG. 27 comprises the panel 119 detachably installed, the partition 122 in the form of a flexible sheet, a shutter 124 slidably installed along the opening, and a roll blind 129 or sliding door 131 prepared by winding a soft flexible sheet on a reel (not shown) and making a pool length changeable so as to make the opening changeable. In addition to the partition panel, a vertical sliding door or encasement can be combined into the manufacturing apparatus in order to make it an optimum one depending on the object and use. The working room is limited to such an opening and the products may be handled by a manipulator installed in the partitioned room.

As set forth above, each member for cleaning air can be reduced in the form a module so that functions corresponding to the manufacturing apparatus 101 may be given depending on its use and object.

What is claimed is:

1. A manufacturing apparatus with an air cleaning device, said manufacturing apparatus comprising:

manufacturing means for manufacturing goods to be manufactured in clean surroundings;

clean air blow-off vent means for supplying clean air to said manufacturing means;

hood means for forming a clean air current sent out of said clean air blow-off vent in the neighborhood of the goods to be manufactured in clean surroundings, said partition means being arranged on the downstream side of said clean air blow-off vent means; and outer shell means for covering said manufacturing means and forming a passageway for the clean air downstream of the goods to pass the clean air around said manufacturing means;

said hood means being between said vent means and said outer shell means for containing the clean air around the goods and maintaining a flow of clean air from the goods to said manufacturing means to prevent contaminents produced by the manufacturing means from reaching the goods;

clean air supply means communicating with the upstream side of said clean air blow-off vent means for supplying pressurized clean air serially through said vent means, said hood means and around the goods, through said outer shell means and around said manufacturing means, and to the outside of the apparatus; and clean air exhaust resistance means for maintaining a positive air pressure within said hood means and said outer shell means to prevent air and contaminants exterior of said apparatus from penetrating to the environment of the goods within said hood means.

2. A manufacturing apparatus with an air cleaning device, according to claim 1, wherein said manufacturing means is for manufacturing goods on an assembly line basis, said manufacturing means being equipped with product transfer means passing through at least one of said outer shell means and said hood means and arranged along the flow of goods.

3. A manufacturing apparatus with an air cleaning device as claimed in claim 2, wherein said clean air supply means includes a support supportedly fixed on said outer shell and installed along said manufacturing means to supply clean air from the upper side of said transfer means.

4. A manufacturing apparatus with an air cleaning device as claimed in claim 1, further including case means encasing said air supply means and disposed above said clean air blow-off vent, and means supporting said case means on the floor independently of said outer shell means, hood means and manufacturing means, and said case means, vent means and clean air supply means being spaced from said outer shell means and separately therefrom sufficiently to prevent the transmission of vibrations from said clean air supply means to said manufacturing means.

5. A manufacturing apparatus with an air cleaning device, according to claim 1, wherein the through flow cross-sectional area of said hood means for the passage of the clean air is substantially smaller than the through-flow cross-sectional area of said outer shell means sufficiently to keep the air pressure adjacent the goods substantially higher than the air pressure around the manufacturing means within said outer shell means.

6. A manufacturing apparatus with an air cleaning device, according to claim 1, wherein said clean air supply means includes a blower installed separate and apart from said manufacturing apparatus, a cylindrical filter installed horizontally in the upper portion of said hood means and having an inlet, duct means communicating between said filter inlet and the outlet of said blower, and said cylindrical filter is equipped with a radially folded filter medium around the periphery thereof; and wherein said hood means is of a substantially U-shape opening downwardly toward said outer shell means.

7. A manufacturing apparatus with an air cleaning device, according to claim 1, further comprising support means mounted independently of said outer shell means and manufacturing means for pivotally supporting said clean air supply means.

8. A manufacturing apparatus with an air cleaning device, according to claim 1, wherein said hood means includes a transparent hood pivotally mounted between an operative position for maintaining pressure within said hood means and a repair position providing access.

9. A manufacturing apparatus with an air cleaning device according to claim 1, wherein said resistance means is a perforated plate extending across the through flow cross-sectional area of said outer shell means.

10. A manufacturing apparatus with an air cleaning device according to claim 9, wherein said resistance plate extends between different portions of said manufacturing means.

11. A manufacturing apparatus with an air cleaning device according to claim 9, wherein said resistance plate extends across and forms an exhaust opening for said outer shell means downstream of all of said manufacturing means.

12. A manufacturing apparatus with an air cleaning device, according to claim 1, wherein said partition means includes a perforated portion for passing a clean air flow downwardly onto the goods and a larger through flow cross-sectional peripheral slot for passing an air curtain downwardly to the side of the goods.

13. A manufacturing apparatus with an air cleaning device, according to claim 1, wherein said air supply means includes two filters, with one of the filters having a substantially greater filtering efficiency than the other filter, and an air plenum with means to provide parallel air flow through the two filters to provide a combined filtering efficiency between the filtering efficiencies of the two filters.

14. A manufacturing apparatus with an air cleaning device, said manufacturing apparatus comprising:

manufacturing means for manufacturing goods to be manufactured in clean surroundings;

clean air blow-off vent means for supplying clean air to said manufacturing means;

partition means for forming a clean air current sent out of said clean air blow-off vent in the neighborhood of the goods to be manufactured in clean surroundings, said partition means being arranged on the downstream side of said clean air blow-off vent means;

outer shell means for covering said manufacturing means;

clean air supply means communicating with the upstream side of said clean air blow-off vent means, said clean air supply means including a plenum above said clean air blow-off vent means, a filter installed within said plenum, a blower installed within said outer shell, an air passage duct communicating between the downstream side of said blower and the plenum upstream of said filter, and means communicating the suction port of the blower directly with the exterior of said outer shell means.

* * * * *